US007922288B2

(12) United States Patent
Mueller

(10) Patent No.: US 7,922,288 B2
(45) Date of Patent: Apr. 12, 2011

(54) PRINTING SYSTEM

(75) Inventor: David A. Mueller, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 597 days.

(21) Appl. No.: 11/292,388

(22) Filed: Nov. 30, 2005

(65) Prior Publication Data

US 2007/0120933 A1 May 31, 2007

(51) Int. Cl.
*B41J 2/21* (2006.01)
*G03G 15/00* (2006.01)

(52) U.S. Cl. ..... 347/43; 347/16; 399/85

(58) Field of Classification Search ..... 347/102, 347/103, 104, 2, 5, 9, 16, 43; 358/1.9, 1.13; 399/85, 2, 298, 299, 223, 309
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A * 5/1993 Horie et al. ..... 399/110
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,561,500 A * 10/1996 Ohzeki et al. ..... 399/85
5,568,246 A 10/1996 Keller et al.
5,570,172 A 10/1996 Acquaviva
5,596,416 A 1/1997 Barry et al.
5,629,762 A 5/1997 Mahoney et al.
5,710,968 A 1/1998 Clark et al.
5,778,377 A 7/1998 Marlin et al.
5,884,910 A 3/1999 Mandel (Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner* — Lam S Nguyen
(74) *Attorney, Agent, or Firm* — Fay Sharpe LLP

(57) ABSTRACT

A printing system includes a first image applying component configured for applying one or more primary colorants to print media for rendering an image. A second image applying component is configured for applying a second colorant, such as black colorant, to print media for rendering an image. A first pathway conveys print media between the first image applying component and the second image applying component. A second pathway bypasses the first image applying component for conveying print media which is printed by the second image applying component. Where an image is to be rendered with the primary colorants and optionally also black, the print media is directed on the first pathway to both the first and second image applying components. Where an image is to be rendered only with black colorant, the print media may be directed to the second image applying component via the bypass pathway. In this way, during black printing, the first image applying component can be placed in a standby mode.

17 Claims, 6 Drawing Sheets

U.S. PATENT DOCUMENTS

| | | | | |
|---|---|---|---|---|
| 5,930,572 | A * | 7/1999 | Haneda et al. | 399/309 |
| 5,995,721 | A | 11/1999 | Rourke et al. | |
| 6,059,284 | A | 5/2000 | Wolf et al. | |
| 6,125,248 | A | 9/2000 | Moser | |
| 6,134,022 | A * | 10/2000 | Yamamoto et al. | 358/1.9 |
| 6,241,242 | B1 | 6/2001 | Munro | |
| 6,297,886 | B1 | 10/2001 | Cornell | |
| 6,317,218 | B1 * | 11/2001 | Yorkey et al. | 358/1.13 |
| 6,324,374 | B1 * | 11/2001 | Sasamoto et al. | 399/298 |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,938,351 | B2 | 9/2005 | Kobayashi et al. | |
| 6,959,165 | B2 | 10/2005 | Mandel et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,159, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

PRINTING SYSTEM

CROSS REFERENCE TO RELATED APPLICATIONS

The following applications, the disclosures of each being totally incorporated herein by reference, are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/093,229, filed Mar. 29, 2005, entitled "PRINTING SYSTEM," by Paul C. Julien;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/109,558, filed Apr. 19, 2005, entitled "SYSTEMS AND METHODS FOR REDUCING IMAGE REGISTRATION ERRORS;" by Michael R. Furst, et al.;

U.S. application Ser. No. 11/109,566, filed Apr. 19, 2005, entitled "MEDIA TRANSPORT SYSTEM," by Barry P. Mandel, et al.; and U.S. application Ser. No. 11/152,275, filed Jun. 14, 2005, entitled "WARM-UP OF MULTIPLE INTEGRATED MARKING ENGINES," by Bryan J. Roof, et al.

BACKGROUND

The exemplary embodiment relates to a printing system. It finds particular application in connection with printing of color and monochrome images by utilizing separate paper delivery pathways which enables components of the printing system not in use at a particular time to be placed in a non-operational mode, and will be described with particular reference thereto. However, it will be appreciated that the embodiment finds application in other systems in which color and monochrome images are rendered.

Electronic printing systems typically employ an input terminal which receives images in digital form and conversion electronics for converting the image to image signals or pixels. The printing system may include a scanner for scanning image-bearing documents or be connected to a computer network which supplies the digital images. The signals are stored and are read out successively to a marking engine for formation of the images and transfer of the images to a print medium, such as paper. Printing systems have been developed which employ multiple marking engines for black, process (or full) color, and custom color (single color or monochrome) printing of selected pages within a print job.

In a typical xerographic marking device, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto paper is generally accomplished by applying heat to the toner with a heated roller and application of pressure. In multi-color printing, successive latent images corresponding to different colors are recorded on the photoconductive surface and developed with toner of a complementary color. Each toner is associated with a separate housing and applied to the paper in sequence. The single color toner images are successively transferred to the copy paper to create a multi-layered toner image on the paper. The multi-layered toner image is then permanently affixed to the copy paper in the fusing process.

Recently, printing systems have been developed which include a plurality of marking engine modules. These systems enable high overall outputs to be achieved by printing portions of the same document on multiple printers. Such systems are commonly referred to as "tandem engine" printers, "parallel" printers, or "cluster printing" (in which an electronic print job may be split up for distributed higher productivity printing by different marking engines, such as separate printing of the color and monochrome pages).

In such machines, color marking engines which print with cyan, magenta, and yellow (CMY) as well as black (K) toners allow printing of both process color and black images on a single marking engine. However, the cost of producing black prints on a color marking engine is often higher than for a dedicated monochrome device. One reason for this is that the color components are often cycled, even during black printing. Although in some systems, the color components can be disabled during the production of monochrome prints, this tends to increase mechanical complexity to provide for retraction of the color components and to disengage their drives. Another reason for the higher cost is that the marking engine may provide a certain interdocument color toner throughput to control toner age in the system.

INCORPORATION BY REFERENCE

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages), and "output merger" or "interposer" systems: U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,489,969 to Soler, et al.; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

BRIEF DESCRIPTION

Aspects of the present disclosure in embodiments thereof include a printing system and a method of printing. In one aspect, a printing system includes a first image applying component configured for applying at least a first of a plurality of colorants to print media for rendering an image. A second image applying component is configured for applying a second of the plurality of colorants to print media for rendering an image. A first pathway conveys print media between the first image applying component and the second image applying component, whereby in a first mode of printing of the printing system, an image rendered on the print media includes the first colorant and the second colorant. A second pathway which bypasses the first image applying component, for conveying print media on which the second image applying component applies the second colorant, whereby in a second mode of printing of the printing system, an image rendered on the print media includes the second colorant and not the first colorant.

In another aspect, a method of printing includes directing print media on which images are to be rendered with at least a first colorant and a second colorant to a first image applying component for applying at least the first colorant and conveying the print media with unfused first colorant to a second image applying component in series with the first image applying component for applying the second colorant. The method further includes directing print media on which images are to be rendered with the second colorant but not with the first colorant to the second image applying component for applying the second colorant, the print media bypassing the first image applying component.

In another aspect, a xerographic printing system includes a first image applying component which applies at least a first colorant to print media. A second image applying component applies at least a second colorant, different from the first colorant, to print media. A conveyor system is configured for selectively conveying print media with unfused first colorant between the first image applying component and the second image applying component and for selectively conveying print media to bypass one of the first and second image applying components, whereby colorant is applied by the other of the first and second image applying components. A fuser receives print media with unfused colorant from the first and second image applying components. The fuser is configured for fusing the first and second colorants.

DETAILED DESCRIPTION

Aspects of the exemplary embodiment, as disclosed herein, relate to a marking engine for a xerographic printing system which is capable of both monochrome (e.g., black) and process color printing and to a method of printing.

The term "marking engine" generally refers to a device for applying an image to print media. The exemplary printing system may include one or more marking engines and a variety of other components, such as finishers, paper feeders, and the like, and may be embodied as a copier, printer, bookmaking machine, facsimile machine, or a multifunction machine. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. A "finisher" can be any post-printing accessory device, such as a tray or trays, sorter, mailbox, inserter, interposer, folder, stapler, stacker, hole puncher, collater, stitcher, binder, envelope stuffer, postage machine, or the like. The operation of applying images to print media, for example, graphics, text, photographs, etc., is generally referred to herein as printing or marking.

Figure 1:
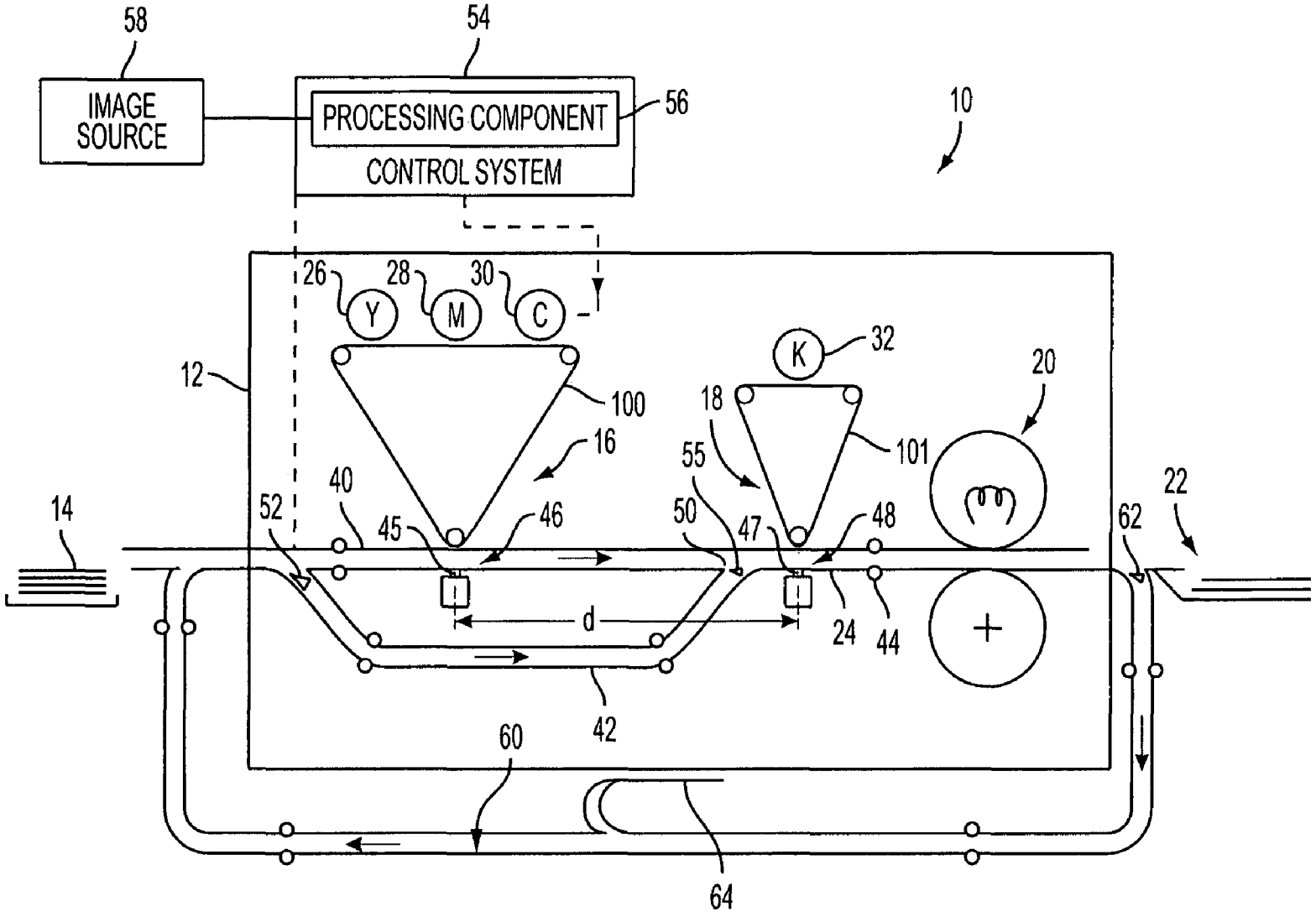
FIG. 1 is a schematic side view of an printing system according to a first aspect of the exemplary embodiment.

With reference to FIG. 1, an exemplary xerographic printing system 10 includes a marking engine 12, which is supplied with print media, such as sheets of paper, from a print media source 14. The marking engine includes a first image applying component 16 which includes a first colorant, such as solid toner particles, and which applies a toner image to print media, a second image applying component 18, in series with the first image applying component 16, which includes a second colorant and applies toner images to print media, and a fuser assembly 20, in series with the first and second image applying components, which fuses the toner images applied by the first and second image applying components to the print media to create a permanent image. Marked and fused sheets are assembled at an output destination 22, such as a finisher. The print media source, marking engine, and output destination are all interconnected by a print media conveyor system 24.

Image applying component 16 may be a process color image applying component which applies one or more colorants to the print media from a set of primary colorants, such as cyan, magenta, and yellow (C, M, Y) colorants from respective colorant sources 26, 28, 30. The image applying component 18 applies a different colorant from those in the set of colorants, generally a single colorant, black (K) in the illustrated embodiment, to the print media from a black colorant source 32 for black only (monochrome) printing or for multicolor printing (when combined with the C, M, and Y colorants). It is to be appreciated that although the black toner which comprises the black colorant may include some similar or identical pigments to those used in forming the C, M, or Y colorants, the black colorant is different to each of these colorants because its overall visible absorption spectrum is different, giving the colorant a different appearance to the observer's eye.

The conveyor system 24 includes a network of paper pathways including a main pathway 40, which conveys print media between the first and second image applying components 16, 18, and a bypass pathway 42, which allows one, but not both, of the image applying components (image applying component 16 in the embodiment of FIG. 1) to be bypassed. The pathways 40, 42, etc. of the conveyor system 24 may be defined by baffles, belts or the like, which constrain the sheets to move in selected directions, and include drive members 44, such as rollers, spherical nips, or vacuum transports which convey the sheets along the pathways. In FIG. 1, the first paper pathway 40 is a color pathway which conveys print media which is to be marked with one or more of the set of primary colorants, such as yellow, magenta, and cyan (Y, M, C) and optionally also black (K). The pathway 40 is coupled with the fuser assembly 20, finisher 22 and the paper source 14. The bypass pathway 42 is a monochrome (black) pathway, which conveys print media which are to be printed only with black colorant so as to bypass the primary colorants. The primary colorants are transferred to the print media at a first nip 45 in a first transfer region 46 in pathway 40 and the black colorant is transferred to the print media at a second nip 47 in a second transfer region 48 in pathway 40, downstream of the colorant transfer region 46. Both colorant transfer regions 46, 48 are upstream of the fuser assembly 20. The bypass pathway 42 merges with the main pathway 40 at a junction 50, which is downstream of the transfer region 46 and upstream of transfer region 48, thus bypassing the primary colorants.

Optionally, a decision gate 52 selectively directs print media from paper supply 14 into pathway 40 or pathway 42. The decision gate 52 may be under the control of a printer control system 54. In this way, a sheet which is to be monochrome (e.g., black only) printed can be directed by the control system into the bypass pathway 42, thereby bypassing the transfer region 46 for the primary colorants. The sheet returns to the main pathway 40 at the junction 50, downstream of the transfer region 46 for application of a monochrome image in the transfer region 48. The applied image is then fused by the fuser 20. Optionally, a second decision gate 55 is provided in the junction 50. In a first position (shown in FIG. 1), the decision gate 55 closes pathway 42 from entry to pathway 40. In this first position, the gate 55 provides a connecting surface for conveying media between the transfer regions 46 and 48. When a color image is applied, the conveying surface helps to avoid disturbance of the applied and unfused image as it is conveyed between the transfer regions 46, 48. In a second position, shown in FIG. 2, the gate 55 provides access to the first pathway 40 from pathway 42. Both gates 52, 55 may be under the control of the control system 54.

During monochrome printing, the image applying component 16 can be placed in a non-operational, e.g., standby mode, in which some or all of its operating components are placed in a state where they suffer less wear and/or operate at lower cost per page than when the sheets are directed through transfer region 46. As a result, the cost per page of monochrome printing is reduced and is more comparable with the costs incurred when a black only printing system is used.

When a sheet is to be printed in color, with one or more of the C, M, Y colorants, the control system 54 actuates the decision gate 52 to direct the sheet onto pathway 40, upstream of the transfer region 46. In this way, an image formed from one or more of the C, M, Y colorants is applied at the transfer region 46. The control system 54 may also set the gate 55 in its first position. The sheet continues without intermediate fusing, to transfer region 48, where the unfused image applied at the transfer region 46 may be supplemented with black colorant to form an image with up to four colorants C, M, Y, and K.

To minimize the risk of disturbing the unfused image between the first transfer region 46 and the fuser 20, the distance d between the first and second transfer regions 46, 48 is, in one embodiment, as short as conveniently possible and may include few or no drive members 44 which may cause disturbance to the sheet. In one embodiment, d is less than a length of a sheet in the process direction. For example d may be less than about 21 cm, e.g., about 20 cm or less for conventional letter size paper which is processed with its shortest dimension (about 21.5 cm) aligned with the process direction. This allows one end of the sheet to be engaged in transfer nip 47 while the other end is simultaneously engaged by transfer nip 45. In this way, accurate registration of a black component of an image can be made with the color component(s) applied upstream. Alternatively for example where distance d is greater than a length of the sheet, a sheet registration system (not shown) may be provided intermediate the transfer nips 45, 47 to ensure correct alignment of the images on the sheet. Such registration systems are known and typically include a sensor for sensing a recognizable feature of the sheet, such as a forward end and drive members for adjusting the position of the sheet or its speed.

The control system 54 may include a processing component 56, which receives a print job comprising images to be rendered from a digital image source 58. The processing component 56 reviews the images to be rendered and for each page, determines whether the page is to be monochrome printed or will require color printing. The control system 54 schedules the operation of the decision gates 52, 55 and the transfer of the sheets through the printing system 10 such that those pages which require only monochrome printing bypass the color transfer region 46 via pathway 42 and those sheets which require color printing are directed along pathway 40. The image source 58 can be a built-in optical scanner which can be used to scan a document such as book pages, a stack of printed pages, or the like, to create a digital image of the scanned document that is reproduced by printing operations performed by the printing system 10. Alternatively, the image source 58 may include an electronic link. For example, a print job can be electronically delivered to the control system 54 via a wired or wireless connection to a digital network (not shown) that interconnects, for example, personal computers or other digital devices. For example, a network user operating word processing software running on a computer may select to print a word processing document on the printing system 10, thus generating the print job, or an external scanner connected to the network may provide the print job in electronic form. The digital network can be a local area network such as a wired Ethernet, a wireless local area network (WLAN), the Internet, some combination thereof, or the like. Moreover, it is contemplated that print jobs may be delivered to the printing system 10 in other ways, such as by using an optical disk reader (not illustrated) built into the printing system 10, or using a dedicated computer connected only to the printing system 10.

When a monochrome print job, or monochrome pages of a print job, are to be printed, the control system 54 communicates this information to the first image applying component 16. This causes the first image applying component to cycle down to a non-operational state when, for example, a preselected minimum number of sheets are scheduled to bypass the transfer region 46. In a non-printing period, one or more of the functions of the first image applying component 16 are typically switched off or allowed to go into a "non-operational" mode where the printer is not ready for printing, such as a low energy mode. It will be appreciated that the first image applying component 16 may have different levels of operation, when more or less of the components are brought to a standby state or to different standby states, depending on the number of sheets which are to bypass the transfer region 46. The determination of what standby level the first image applying component 16 is placed in may be determined by suitable algorithms in either the control system 54 or associated with the first image applying component 16. For example, the control system 54 determines how long the period between marking operations will be and determines whether the first image applying component 16 should completely cycle down, or only shut down some of its operational functions. Where the control system determines that the first image applying component 16 will be required again in a relatively short time, the first image applying component 16 may be placed in an intermediate low energy mode, where some, but not all the functions are switched to a standby mode. This is because some of the marking engine components are more subject to damage than others when not in continuous use. Some components may take longer to be brought to a non-operational mode or returned to an operational mode and thus it is only beneficial to begin cycling these components down when a relatively long period of inactivity is scheduled. For each component, there is generally a predetermined period, after which the component is switched to a non-operational mode to avoid potential damage to the image applying component/reduce overall printing costs.

Optionally, an inversion path 60 is provided by which once printed media is inverted for duplex (two sided) printing in the marking engine 12. In the illustrated embodiment, the inversion path 60 is accessed from the first pathway 40, downstream of the fuser assembly 20, by means of a decision gate 62, and connects with the pathway 40 upstream of the decision gate 52 and upstream of the transfer region 46. The inversion path 60 includes an inverter 64, which inverts the sheet to present a second side to the transfer region 46 and or 48 for color/black only printing.

Figure 2:
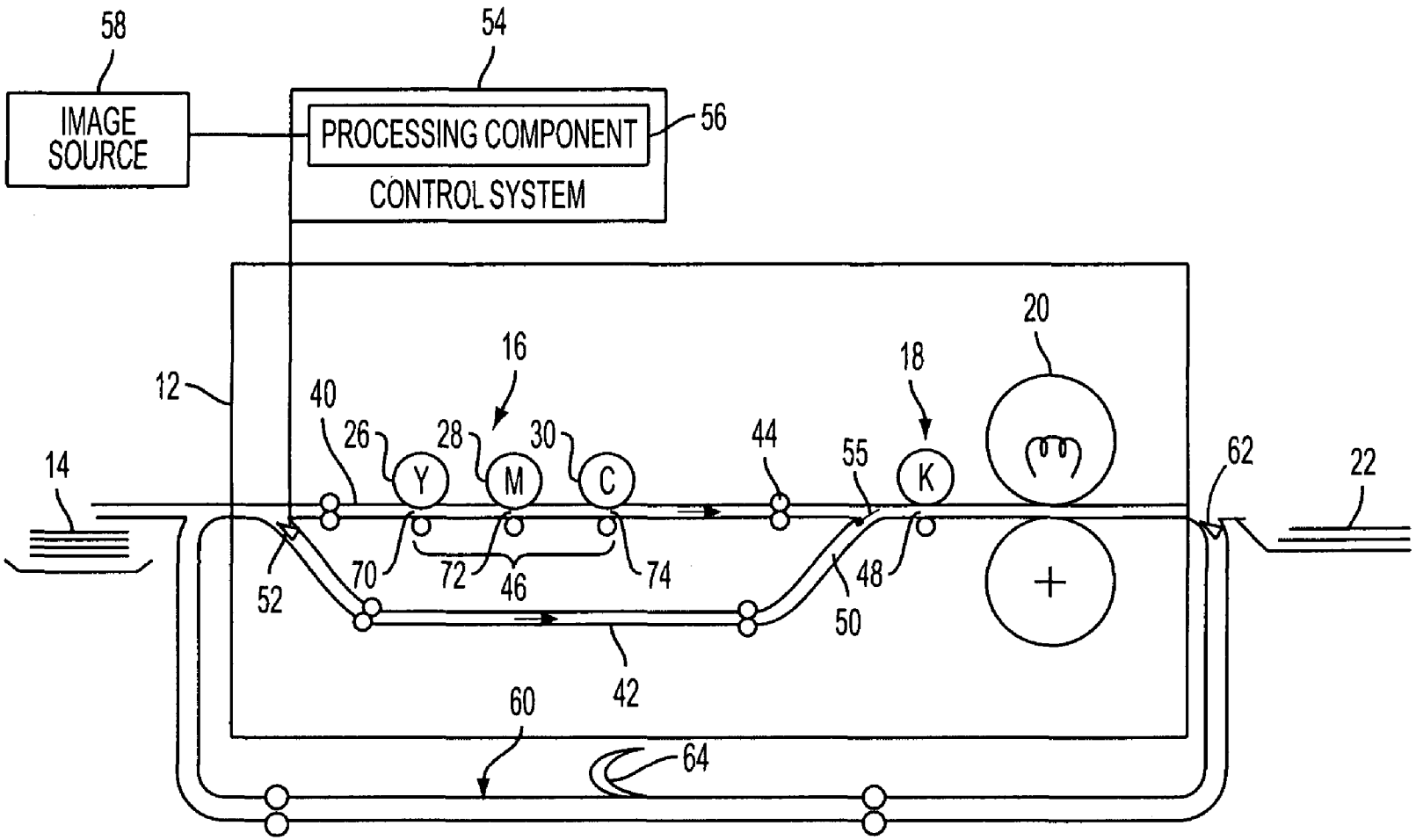
FIG. 2 is a schematic side view of an printing system according to a first aspect of the exemplary embodiment.

FIG. 2 shows an alternative embodiment of a printing system 10 which can be similarly configured to the embodiment of FIG. 1, except as otherwise noted. Similar elements are accorded the same numerals. The C, M, and Y colorants, and also the black colorant, K, may be applied directly to the print media in this embodiment. The transfer region 46 includes three discrete transfer nips 70, 72, 74, one for each of the primary colorants. As with the embodiment of FIG. 1, the transfer region 46, comprising transfer nips 70, 72, 74, is entirely upstream of the junction 50 where sheets to be black only printed in the image applying component 18 enter the pathway 40. In the embodiment of FIG. 2, which may be described as a direct to paper system, image applying component 16 includes multiple toner image-forming units, one for each colorant. Developed images for each colorant are separately and sequentially applied to the sheet as it is conveyed along pathway 40 to give a final superimposed image on the sheet.

In other embodiments, the first image applying component 16 may be configured as for FIG. 1 while the second image applying component 18 is configured as for FIG. 2, or vice versa. While the printing system 10 is illustrated in FIGS. 1 and 2 as including a single marking engine 12, it will be appreciated that any number of marking engines may be employed in the printing system 10, such as one, two, three, four, or six marking engines.

Figure 3:
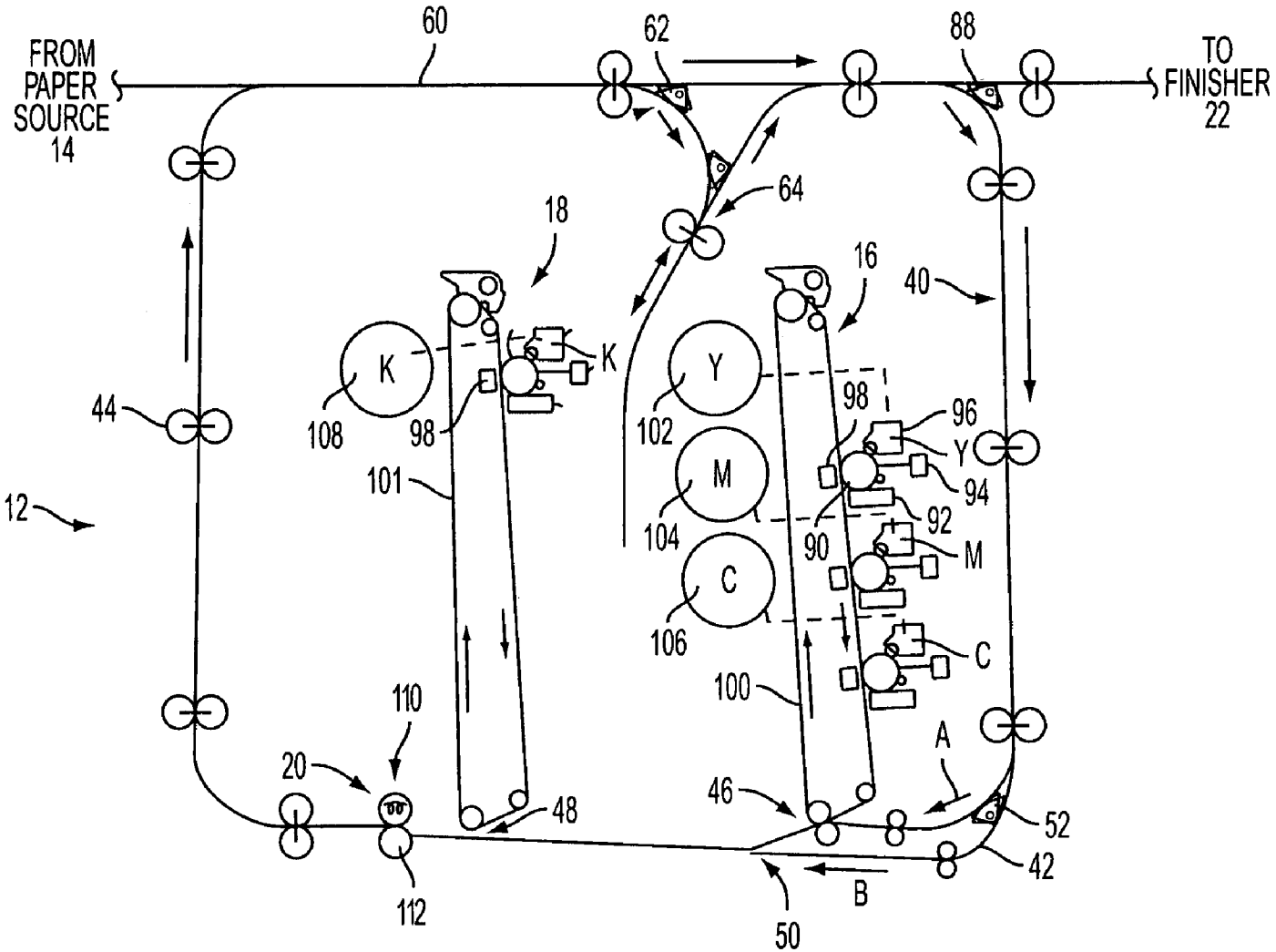
FIG. 3 is a side sectional view of one embodiment of a marking engine of the printing system of FIG. 1.

With reference now to FIG. 3, a side sectional view of an exemplary marking engine 12 of the type illustrated schematically in FIG. 1 is shown. The marking engine is illustrated as a xerographic marking engine. In this embodiment, the main marking engine pathway 40 is accessed from the inversion 60 pathway at a decision gate 88.

As illustrated in FIG. 3, the color and black image applying components 16, 18 include various xerographic subsystems for forming an image and for transferring the image to a sheet of paper. In the illustrated marking engine 12, the color image applying component 16 includes, for each colorant, a charge retentive surface 90, such as a rotating photoreceptor in the form of a belt or drum. The images are created on a surface of the photoreceptor 90. Disposed at various points around the circumference of the photoreceptor 90 are the xerographic subsystems, which include, for each of the colors to be applied, a charging station 92, such as a charging corotron, an exposure station 94, which forms a latent image on the photoreceptor, such as a Raster Output Scanner (ROS) or LED bar, and a developer unit 96, respectively, associated with each charging station for developing the latent image formed on the surface of the photoreceptor by applying a respective toner to obtain a toner image, as is known in the art. A transfer unit 98, such as a transfer corotron, transfers the toner image to an intermediate transfer belt 100 which in turn transfers the image to the paper at the transfer region 46. In operation, the photoreceptor 90 rotates and is charged at the charging station 92. The charged surface arrives at the exposure station 94, where a latent image is formed. The portion of the photoreceptor on which the latent image is formed arrives at the developer unit 96, which applies a marking material, comprising toner particles, to the latent image to obtain a toner image. The developed image moves with the photoreceptor to the transferring unit 98 which transfers the toner image thus formed to the intermediate transfer belt 100 by applying a potential to the sheet. A printing system of this type is described, for example, in U.S. Pat. No. 6,938,351 to Kobayashi, et al. entitled "IMAGE FORMING DEVICE," which is incorporated herein by reference. The image applying component 18 may be similarly configured to the image applying component 16, with its own intermediate transfer belt 101, except that in one aspect, only the xerographic subsystems for applying one colorant are required (although it is also contemplated that image applying component 18 may apply more than one colorant, such as one or more of: black, one or more highlight colors, and magnetic ink character recognition (MICR) toner. A toner cartridge 102, 104, 106, 108 for each of the colorants C, M, Y, K supplies the respective developer housing 96 with toner. The combination of the respective developer housings 96 with the toner cartridges 102, 104, 106, and 108 constitute the colorant sources 26, 28, 30, and 32 illustrated schematically in FIG. 1. The fuser assembly 20 generally includes a heated roller 110 and a pressure roller 112, which define a nip therebetween. The rendered image is permanently affixed to the print media in the fuser assembly by the application of heat and pressure.

In the standby (non-operational) mode, during black-only printing, one or more of the xerographic subsystems 90, 92, 94, 98, and optionally also transfer belt 100 of image applying component 16 may be placed in a standby mode. For example, the photoreceptor 90 and/or transfer belt 100 may be stopped or slowed down, the power to the corotrons 92, 98 and/or exposure station 94 may be switched off or reduced, and the agitators (not shown) which normally churn the toner and carrier material in developer housing 96 may be switched off.

It will be appreciated that the printing system of FIG. 2 may be similarly configured to that of FIG. 3, except in that the transfer belts 100, 101 are omitted and each photoreceptor 90 is situated to transfer the respective colorant image (C, M, Y, and K directly to the sheet in the transfer region 46 or 48 by means of a respective transfer corotron 98. In this embodiment, the transfer belts are not required.

In yet another embodiment, the xerographic components 92, 94, 96, for the three colorants C, M, and Y are arranged around the same photoreceptor 90 and transferred to the print media from the photoreceptor at the transfer region 46 by a single transfer corotron 98. In this embodiment, the transfer belts 100, 101 are not required.

The illustrated marking engine 12 employs xerographic printing technology, in which an electrostatic image is formed and coated with a toner material, and then transferred and fused to paper or another print medium by application of heat and/or pressure. However, marking engines employing other printing technologies can be provided, such as marking engines employing ink jet transfer, thermal impact printing, or the like in which the fuser assembly serves to dry or otherwise fix the ink to the sheet.

It is to be appreciated that the marking engine 12 can include an input/output interface, a memory, a marking cartridge platform, a marking driver, a function switch, a controller and a self-diagnostic unit, all of which can be interconnected by a data/control bus. In this embodiment, the control system 54 may control the operations of each of these components.

The printing system 10 executes print jobs. Print job execution involves printing images, such as selected text, line graphics, photographs, MICR notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 10 are determined by the capabilities of the paper source 14, marking engine(s) 12, and finisher 22 of the printing system 10. In some embodiments, the printing system 10 may be a cluster of networked or otherwise logically interconnected image applying components, each having its own associated print media source.

The printing systems of FIGS. 1 and 2 have advantages over a printing system in which a color (CMYK) marking engine handles color jobs and a separate black marking engine handles black only jobs. In particular, the printing system 10 eliminates the need for two black housings (one in the color marking engine, the other in the black marking engine), two fusers (one for each marking engine), and other associated hardware. In the present system, only one developer housing is required for each colorant to be employed and a single fuser 20 may fuse all the colorants used. The present system can also have a smaller footprint (occupying less space) than a system with two marking engines. As discussed above, the printing system also has advantages over a printing system in which a conventional CMYK color marking engine handles both black and color jobs in that the per page costs of black printing can be reduced/and/or wear to the printing system reduced.

Figure 4:
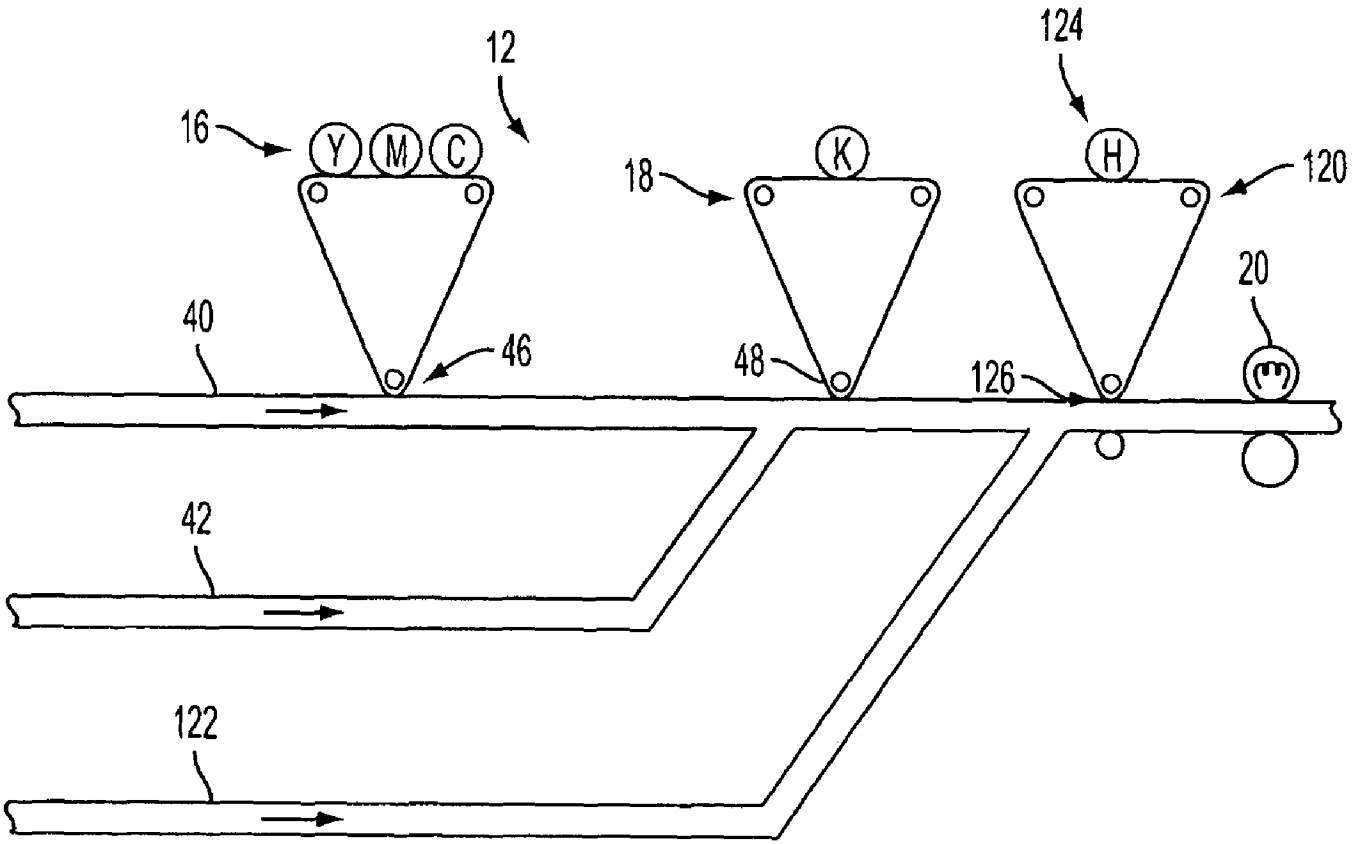
FIG. 4 is schematic side view of a printing system according to a third aspect of the exemplary embodiment.
Figure 5:
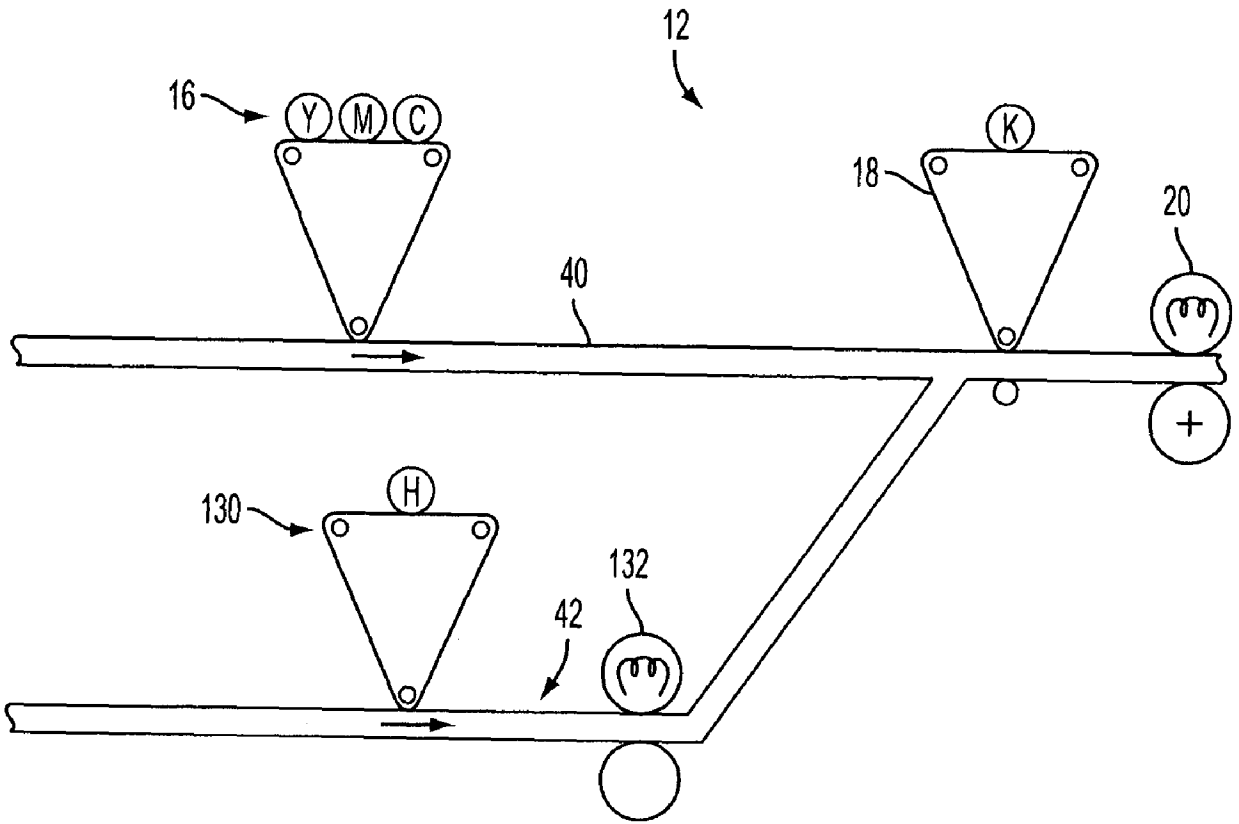
FIG. 5 is schematic side view of a printing system according to a third aspect of the exemplary embodiment.
Figure 6:
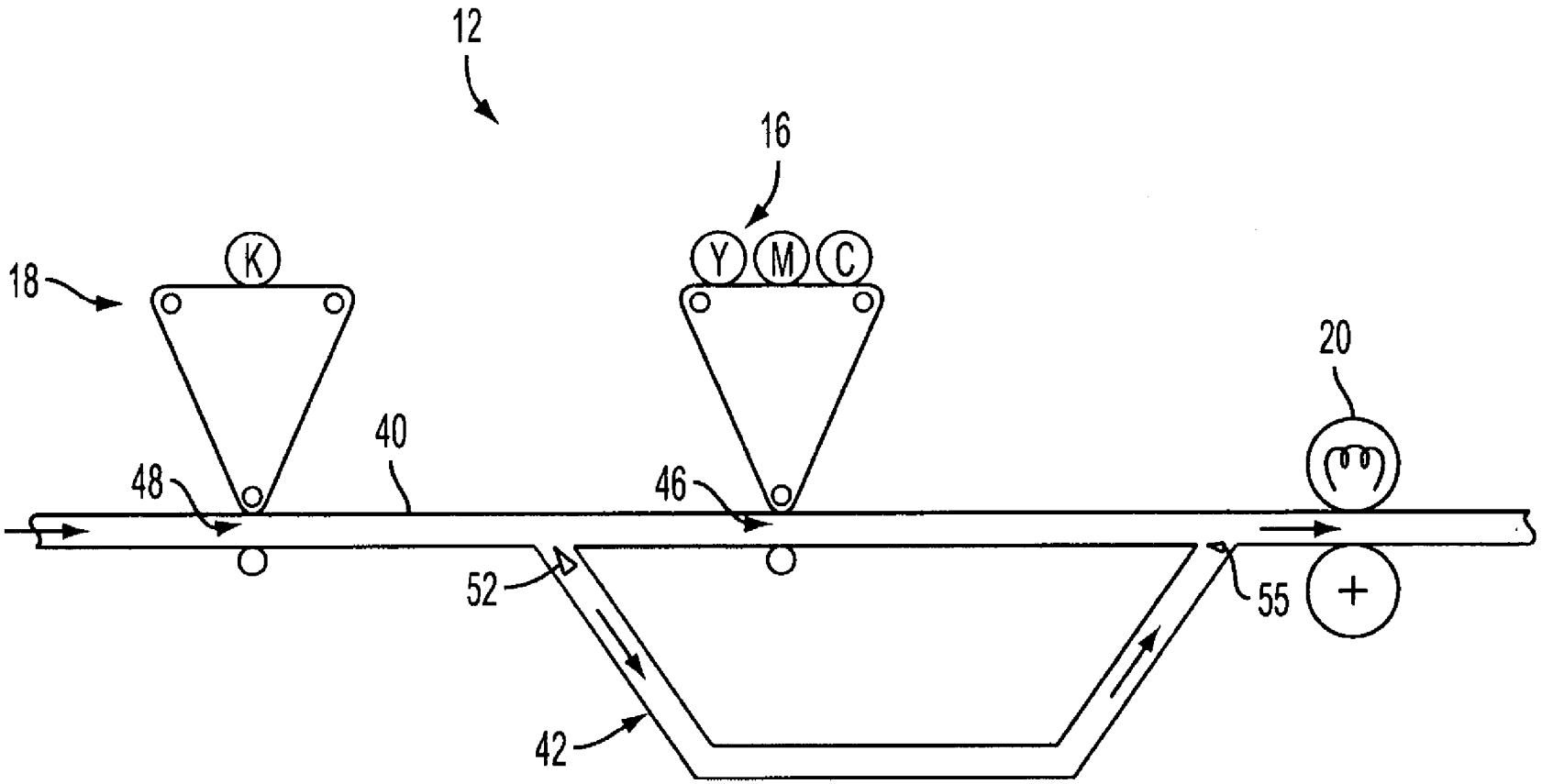
FIG. 6 is schematic side view of a printing system according to a third aspect of the exemplary embodiment.

FIGS. 4-6 show alternative embodiments of a marking engine 12 which can be incorporated into the printing system 10. The marking engine 12 of these embodiments can be similarly configured to that of FIG. 1 or FIG. 2, except as otherwise noted. Similar elements are accorded the same numerals. In the system of FIG. 4, in addition to image applying components 16 and 18 for C, M, Y and K colorants, respectively, a third image applying component 120 is provided for a colorant which may be different from each of the other colorants in the printing system. In the illustrated embodiment, the third image applying component 120 applies a highlight colorant or other specially mixed colorant, which allows the colorant to be rendered with greater accuracy than by a combination of the C, M, Y colorants. Or, the colorant may be a MICR colorant. In the embodiment of FIG. 4, a second bypass pathway 122 is optionally provided, which like the bypass pathway 42, merges with main pathway 40, downstream of the first transfer region 46. In the illustrated example, pathway 122 merges with pathway 40 intermediate the second transfer region 48 and the fuser. The image applying component 120 includes a source 124 of the highlight colorant, which is transferred to the sheet at a transfer region 126 in pathway 40. Image applying component 120 can be similarly configured to image applying component 18 of FIG. 1 or FIG. 2.

In the marking engine 12 of FIG. 5, a third image applying component 130 is associated with pathway 42. Image applying component 130 may be similarly configured to image applying component 120 of FIG. 4. Optionally, image applying component 130 is associated with its own fuser 132.

In the marking engine of FIG. 6, black image applying component 18 is located upstream of color image applying component 16. A bypass pathway 42 controlled by gates 52, 55 allows color image applying component 16 to be bypassed for black only printing. In this embodiment, bypass pathway 42 splits from main pathway intermediate the black and color image applying components 18, 16, and rejoins the main pathway 40 downstream of the color image applying component 16.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a source of print media;

a first image applying component configured for only applying cyan, magenta and yellow colorants and not black colorant to the print media for rendering an image, each of the colorants comprising a respective toner, each toner comprising toner particles, the first image applying component comprising at least one photoreceptor on which the toner particles of the cyan, magenta and yellow colorants form a toner image which is transferred to the print media;

a second, monochrome image applying component configured for only applying black colorant and not cyan, magenta, and yellow colorants to the print media for rendering an image, the second image applying component comprising a photoreceptor on which the toner particles of the black colorant form a toner image which is transferred to the print media;

a first pathway which conveys print media from the source to the first image applying component and from the first image applying component to the second image applying component, whereby in a first mode of printing of the printing system, an image rendered on the print media includes the cyan, magenta, yellow and black colorants and, and wherein in the first mode, the first pathway conveys print media with unfused cyan, magenta and yellow colorants between the first image applying component and the second image applying component; and a second pathway from the source of print media which bypasses the first image applying component and merges with the first pathway, for conveying print media on which the second image applying component applies the black colorant, whereby in a second mode of printing of the printing system, an image rendered on the print media includes the black colorant and not the cyan, magenta, and yellow colorants.

2. The printing system of claim 1, further comprising a fuser which fuses the rendered toner images to the print media, the fuser selectively receiving print media from the first pathway and the second pathway.

3. The printing system of claim 2, wherein the first and second imaging components are upstream of the fuser.

4. The printing system of claim 2, wherein the second pathway merges with the first pathway upstream of the fuser.

5. The printing system of claim 1, further comprising a finisher which receives print media from the first and second imaging components.

6. The printing system of claim 1, further comprising a control system which is configured for identifying images which are to be rendered with only the second colorant, the control system communicating with the first image applying component such that the first image applying component is in a non-operational mode while an image be rendered with only the second colorant is rendered with the second image applying component.

7. A printing system comprising:

a first image applying component configured for applying at least a first of a plurality of colorants to print media for rendering an image;

a second image applying component configured for applying a second of the plurality of colorants to print media for rendering an image, the first and second colorants comprising toner particles, the first and second image applying components each comprising a photoreceptor on which the toner particles of the respective colorant form a toner image, the second colorant being different from all the colorants applied by the first image applying component;

a third image applying component configured for applying a third of the plurality of colorants to print media for rendering an image;

a first pathway which conveys print media between the first image applying component and the second image applying component, whereby in a first mode of printing of the printing system, an image rendered on the print media includes the first colorant and at least the second colorant; and a second pathway which bypasses the first image applying component, for conveying print media on which the second image applying component applies the second colorant and the third image applying component applies the third colorant, whereby in a second mode of printing of the printing system, an image rendered on the print media includes the second and third colorants and not the first colorant.

8. The printing system of claim 7, further comprising:

a fuser for contemporaneously fusing unfused first and second colorants in the first mode of printing and fusing at least the second unfused colorant in the second mode of printing.

9. The printing system of claim 8, further comprising a source of print media which supplies print media to the first and second image applying components, the source of print media being selectively coupled with the first pathway and the second pathway.

10. The printing system of claim 9, further comprising a decision gate which selectively couples the source of print media with one of the first and second pathways.

11. The printing system of claim 7, wherein the second pathway merges with the first pathway downstream of the first image applying component.

12. The printing system of claim 7, further comprising:

a third pathway which bypasses the first image applying component and the second image applying component, for conveying print media on which the third image applying component applies the third colorant in a third mode of printing in which an image rendered on the print media includes the third colorant and not the first and second colorants.

13. The printing system of claim 12, wherein the third pathway merges with the first pathway downstream of the first and second image applying components.

14. The printing system of claim 7, wherein the first pathway includes the first, second, and third image forming devices, the second pathway includes the second and third image forming devices but not the first image forming device, and a third pathway includes the third image forming device but not the first and second image forming devices.

15. The printing system of claim 7, wherein the first pathway includes the first and second image forming devices but not the third image forming device and the second pathway includes the second and third image forming devices but not the first image forming device.

16. The printing system of claim 7, wherein the third image applying component comprises a photoreceptor on which toner particles of the third colorant form a toner image.

17. The system of claim 7, wherein the third colorant comprises a highlight colorant.

* * * * *